US008593368B2

(12) United States Patent
Lee et al.

(10) Patent No.: US 8,593,368 B2
(45) Date of Patent: Nov. 26, 2013

(54) MULTI-BAND ANTENNA AND ELECTRONIC APPARATUS HAVING THE SAME

(75) Inventors: Cheng-Tse Lee, Yilan County (TW); Saou-Wen Su, Keelung (TW)

(73) Assignees: Lite-On Electronics (Guangzhou) Limited, Guangzhou (CN); Lite-On Technology Corporation, Taipei (TW)

( * ) Notice: Subject to any disclaimer, the term of this patent is extended or adjusted under 35 U.S.C. 154(b) by 286 days.

(21) Appl. No.: 13/207,387

(22) Filed: Aug. 10, 2011

(65) Prior Publication Data

US 2012/0326940 A1 Dec. 27, 2012

(30) Foreign Application Priority Data

Jun. 27, 2011 (CN) ..... 2011 1 0174026

(51) Int. Cl.
*H01Q 1/50* (2006.01)

(52) U.S. Cl.
USPC ..... 343/860

(58) Field of Classification Search
USPC ..... 343/860, 700 MS, 702, 846
See application file for complete search history.

(56) References Cited

U.S. PATENT DOCUMENTS

| | | | | |
|---|---|---|---|---|
| 7,352,326 | B2 * | 4/2008 | Korva et al. | 343/700 MS |
| 8,022,881 | B2 * | 9/2011 | Wong et al. | 343/700 MS |
| 2004/0085245 | A1 * | 5/2004 | Miyata et al. | 343/700 MS |
| 2008/0122714 | A1 * | 5/2008 | Ishihara et al. | 343/750 |
| 2011/0084883 | A1 * | 4/2011 | Wong et al. | 343/702 |
| 2012/0146874 | A1 * | 6/2012 | Lee et al. | 343/841 |

* cited by examiner

*Primary Examiner* — Huedung Mancuso
(74) *Attorney, Agent, or Firm* — Li & Cai Intellectual Property (USA) Office

(57) ABSTRACT

A multi-band antenna includes an antenna substrate, an antenna ground, an antenna unit, and a matching conductor. The antenna ground has a signal ground terminal and at least one bend. The antenna unit is adjacent to the antenna ground. The matching conductor is electrically coupled to the antenna ground, and an angle exists between the matching conductor and the antenna ground. A length of the first matching conductor is about a quarter of the wavelength corresponding to a frequency of the first operating band. The antenna unit includes a coupling conductor, a feeding conductor, a radiating conductor, and a shorting conductor. The feeding conductor has a signal feeding terminal One end of the radiating conductor is facing to the antenna ground, and a distance exists between the feeding conductor the antenna ground. Two ends of the shorting conductor are respectively electrically coupled to the antenna ground and the coupling conductor.

20 Claims, 9 Drawing Sheets

MULTI-BAND ANTENNA AND ELECTRONIC APPARATUS HAVING THE SAME

BACKGROUND

1. Technical Field

The present disclosure relates to an antenna and electronic apparatus using the same, and more particularly to a multi-band antenna having a matching conductor and electronic apparatus using the same.

2. Description of Related Art

Generally, a conventional antenna apparatus may utilize the system ground as the antenna ground for getting better impedance matching and bandwidth operating for the most part. Normally, electronic manufacturers may design the antenna matching the system ground of electronic products according to different specifications of products, and the antenna is having better radiation efficiency. When electronic manufacturers developed different types of electronic products, they usually need to redesign the configuration of the antenna, and the design cost is thus increased.

SUMMARY

An exemplary embodiment of the present disclosure provides a multi-band antenna including an antenna substrate, an antenna ground, an antenna unit, and a first matching conductor, wherein the antenna ground, the antenna unit and the first matching conductor are located on the antenna substrate. The antenna ground has a signal ground terminal and at least one bend. The antenna unit is adjacent to the antenna ground, and provides a first and second operating bands. One end of the first matching conductor is electrically coupled to the antenna ground, and there is a first angel between the first matching conductor and the antenna. A length of first matching conductor is about a quarter of the wavelength corresponding to a frequency of the first operating band. The antenna unit includes a coupling conductor, a feeding conductor, a radiating conductor, and a shorting conductor. The feeding conductor located in between the antenna ground, and the coupling conductor is extended along the coupling conductor. There is a first distance between the feeding conductor and the coupling conductor, and the feeding conductor has a signal feeding terminal corresponding to the signal ground terminal One end of the radiating conductor is electrically coupled to the coupling conductor, and the other end is facing to the antenna ground, wherein there is a second distance between the radiating conductor and the antenna ground. One end of the shorting conductor is electrically coupled to the coupling conductor, and the other end of the shorting conductor is coupled to the antenna ground.

According to an exemplary embodiment of the present disclosure, a width of the above-mentioned antenna ground is less than or equal to one-tenth of a length of the antenna ground.

According to an exemplary embodiment of the present disclosure, the above-mentioned multi-band antenna further includes a second matching conductor. One end of the second matching conductor is electrically coupled to the antenna ground, and a length of the second matching conductor is about a quarter of the wavelength corresponding to a frequency of the second operating band, wherein there is a second angle between the second matching conductor and the antenna ground.

An exemplary embodiment of the present disclosure provides an electronic apparatus including an electronic apparatus body and the above-mentioned multi-band antenna. The electronic apparatus body includes a system ground, a cable, and one or a plurality of electronic chips located on the system ground. The multi-band antenna is electrically coupled to electronic apparatus body via the cable, wherein the signal feeding terminal of the feeding conductor is electrically coupled to a signal wire of the cable, and a signal ground terminal of the antenna ground is electrically coupled to a ground wire of the cable. Therefore, the antenna unit is electrically coupled to the electronic apparatus body via the cable.

To sum up, the exemplary embodiment of the present disclosure provides a multi-band antenna adapted to the electronic apparatus. Without being integrated into the system ground, the multi-band antenna may have the great radiation efficiency and multi-band operation. In other words, the multi-band antenna is an independent antenna, and manufacturers don't have to redesign antenna for different types of electronic products. Consequently, the manufacturing cost is reduced. Furthermore, manufacturers may control a radiation pattern of the multi-band antenna by adjusting the angle between the matching conductor and the antenna ground for suiting applied requirements of products.

In order to further understand the techniques, means and effects the present disclosure, the following detailed descriptions and appended drawings are hereby referred, such that, through which, the purposes, features and aspects of the present disclosure can be thoroughly and concretely appreciated; however, the appended drawings are merely provided for reference and illustration, without any intention to be used for limiting the present disclosure.

BRIEF DESCRIPTION OF THE DRAWINGS

The accompanying drawings are included to provide a further understanding of the present disclosure, and are incorporated in and constitute a part of this specification. The drawings illustrate exemplary embodiments of the present disclosure and, together with the description, serve to explain the principles of the present disclosure.

DESCRIPTION OF THE EXEMPLARY EMBODIMENTS

Figure 1:
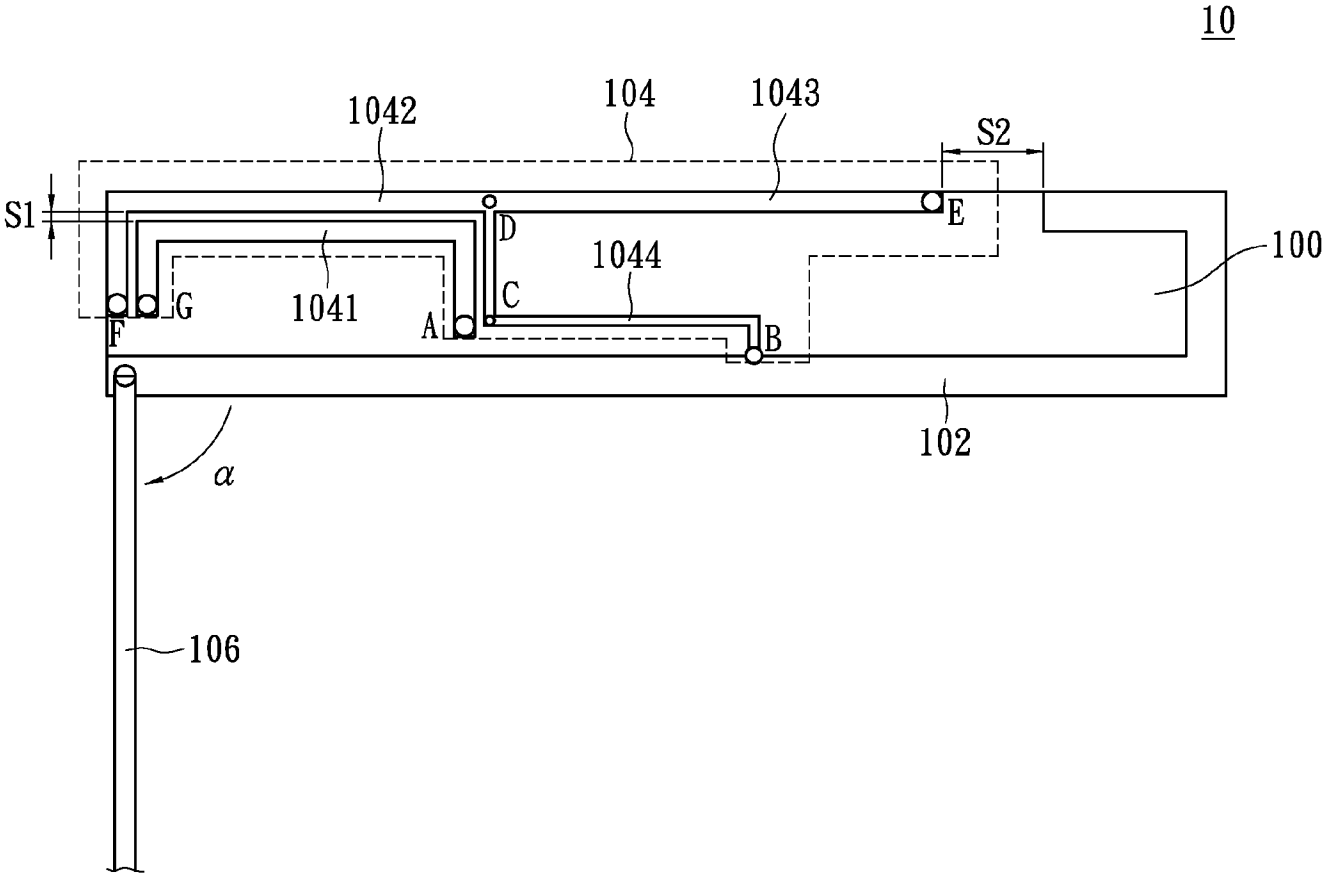
FIG. 1 shows a plan view of a multi-band antenna according to an exemplary embodiment form the present disclosure.

Reference will now be made in detail to the exemplary embodiments of the present disclosure, examples of which are illustrated in the accompanying drawings. Wherever possible, the same reference numbers are used in the drawings and the description to refer to the same or like parts.

[Exemplary Embodiment of the Multi-Band Antenna]

Please refer to FIG. 1 which is a plan view of a multi-band antenna according to an exemplary embodiment form the present disclosure. A multi-band antenna 10 includes an antenna substrate 100, an antenna ground 102, an antenna unit 104, and a matching conductor 106. The antenna ground 102 may be a ground placed independently and externally to the electronic apparatus body. Therefore, the multi-band antenna 10 is an independent antenna, and the manner of antenna design may reduce issues of matching and integration between the multi-band antenna 10 and the system ground of the electronic apparatus body.

The antenna substrate 100 may be an elongated rectangle of a substrate, such as a FR4 multi-layer substrate. The antenna substrate 100 has a surface (i.e. the surface of the antenna substrate 100 shown in the FIG. 1), wherein the antenna ground 102 and the antenna unit 104 are located on the antenna substrate 100. For example, the antenna ground 102 and the antenna unit 104 are printed on the surface of the antenna substrate 100 by the plan printing technique. However, it is noteworthy that the manner for making the antenna ground 102 and the antenna unit 104 located on the surface is not limited thereto. Furthermore, the above-mentioned shape and material of the antenna substrate 100 are also not used for limiting the present disclosure.

The antenna ground 102 has a signal ground terminal and at least one bend, for example, the antenna ground 102 of the FIG. 1 is an elongated wire having two bends. A width of the antenna ground 102 is less than or equal to one-tenth of a length of the antenna ground 102 for reducing the dimension of the multi-band antenna 10, and the multi-band antenna 10 could be therefore located into the miniaturized electronic apparatus.

The located antenna unit 104 is adjacent to the antenna ground 102, wherein there is a distance S2 between one end (terminal E) of the antenna unit 104 and the antenna ground 102, and the other end (terminal B) of the antenna unit 104 is electrically coupled to the antenna ground 102. The antenna unit 104 is used to provide the first and second operating bands, for example, the first operating band includes Global System for Mobile Communication 850/900 megahertz (GSM 850/900 band, 824 megahertz to 960 megahertz), and the second operating band includes Global System for Mobile Communication 1800/1900 megahertz (GSM 1800/1900 band, 1710 megahertz to 1990 megahertz) and Universal Mobile Telecommunication System band (UMTS band, 1920 megahertz to 2170 megahertz). It is noteworthy that the range of the above-mentioned first and second operating bands is not used for limiting the present disclosure.

One end of the matching conductor 106 is electrically coupled to the antenna ground 102, and a length of the matching conductor 106 is about a quarter of a wavelength corresponding to any frequency (such as the center frequency) of the first operating band. The matching conductor 106 is served as the extension of the antenna ground 102, the multi-band antenna 10 may get great impedance-bandwidth and radiating characteristic by changing the length of the matching conductor 106, and the length of the matching conductor 106 therefore relates to a wavelength corresponding to any frequency (such as the center frequency) of the first operating band. In the exemplary embodiment of the present disclosure, the matching conductor 106 may be a matching wire, and the present disclosure is limited thereto.

Furthermore, there is an angle $\alpha$ between the matching conductor 106 and the antenna ground 102, and the angle $\alpha$ may be adjusted according to requirements of the radiation pattern. Thus, the range of the angle $\alpha$ is from zero to 180 degrees. In other words, the radiation pattern of the multi-band antenna 10 may be changed by adjusting the angle $\alpha$. For example, the angle $\alpha$ is 90 degrees.

It is noteworthy that the location of the matching conductor 106 on the antenna ground 102 is not limited. In other words, one end of the matching conductor 106 may be randomly on any location of the antenna ground 102. Furthermore, although the multi-band antenna 10 only has one matching conductor 106, the amount of matching conductors of the multi-band antenna 10 may be more than one.

The antenna unit 104 includes a feeding conductor 1041, a coupling conductor 1042, a radiating conductor 1043, and a shorting conductor 1044, for forming a T-shaped monopole antenna. However, it is noted that the shape and implementation of the antenna unit 104 are not used for limiting the present disclosure.

For example, the feeding conductor 1041 may be a feeding wire formed by the metal wire from the terminal A to the terminal G, and the coupling conductor 1042 may be a coupling wire formed by the metal wire from the terminal C to the terminal F. The feeding conductor 1041 located between the antenna ground 102 and the coupling conductor 1042 is extended along the coupling conductor 1042. The feeding conductor 1041 has a signal feeding terminal corresponding to the signal ground terminal of the antenna ground 102, and there is a distance Si between the feeding conductor 1041 and the coupling conductor 1042.

According to the exemplary embodiment of the present disclosure, for example, the signal ground terminal of the antenna ground 102 may be located on the terminal B and the signal feeding terminal of the feeding conductor 1041 may be located on the terminal A. The signal received from the signal feeding terminal of the feeding conductor 1041 induces the electromagnetic energy to the coupling conductor 1042 by signal coupling.

For example, the radiating conductor 1043 may be a radiating wire formed by the metal wire from the terminal D to the terminal E. One end (terminal D) of the radiating conductor 1043 is electrically coupled to the coupling conductor 1042, and the other end (terminal E) of the radiating conductor 1043 is facing to the antenna ground 102, wherein there is a distance S2 between the radiating conductor 1043 and the antenna ground 102.

For example, the shorting conductor 1044 may be a shorting wire formed by the metal wire from the terminal B to the terminal C. One end (terminal C) of the shorting conductor 1044 is electrically coupled to the coupling conductor 1042, and the other end (terminal B) of the shorting conductor 1044 is electrically coupled to the antenna ground 102.

According to the exemplary embodiment of the present disclosure, for example, the distance S1 is 0.5 millimeters, the thickness of the antenna substrate 100 is 1 millimeters, the antenna ground 102 has 55 millimeters of the length and 2 millimeters of the width, and the length of the matching conductor 106 is about 80 millimeters. However, it is noteworthy that the dimensions of the above-mentioned components are not used for limiting the present disclosure.

Figure 2:
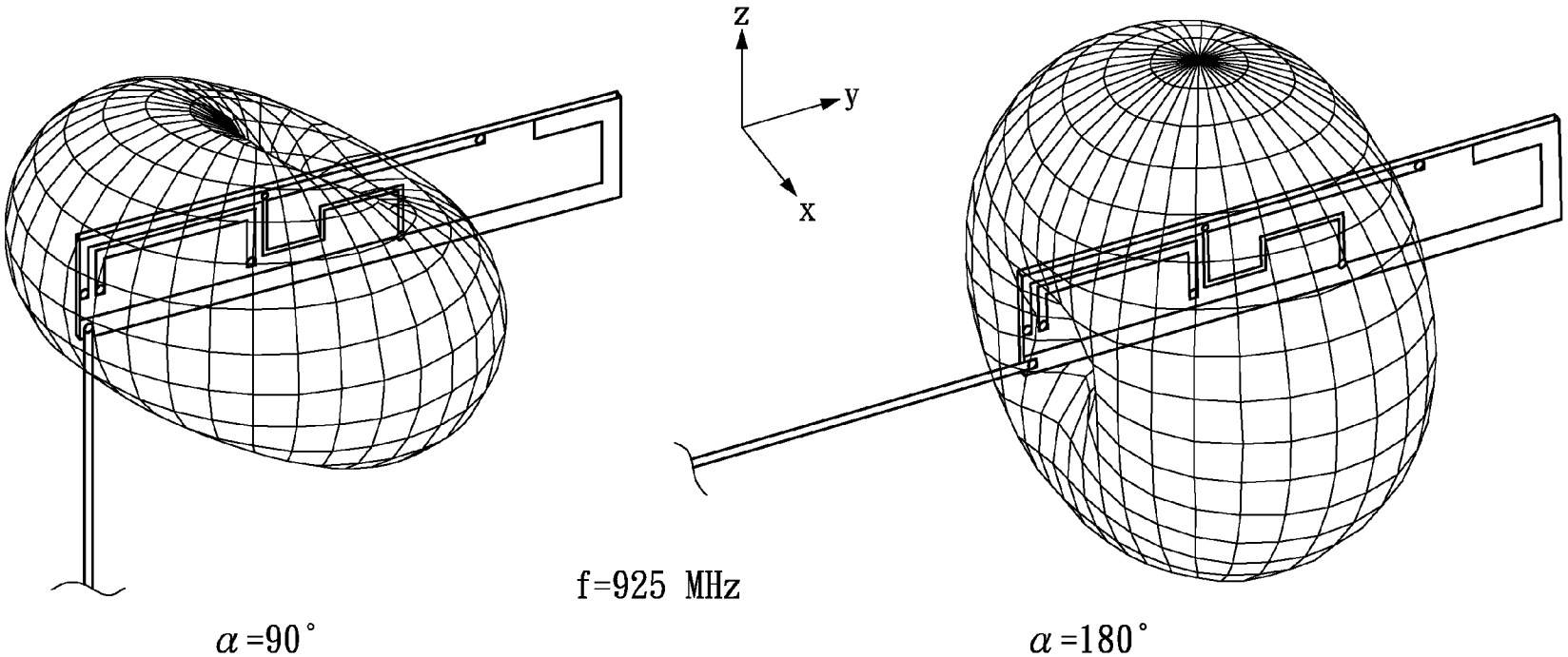
FIG. 2 shows a radiation pattern diagram of a multi-band antenna operated at the band of 925 megahertz according to an exemplary embodiment from the present disclosure.
Figure 3:
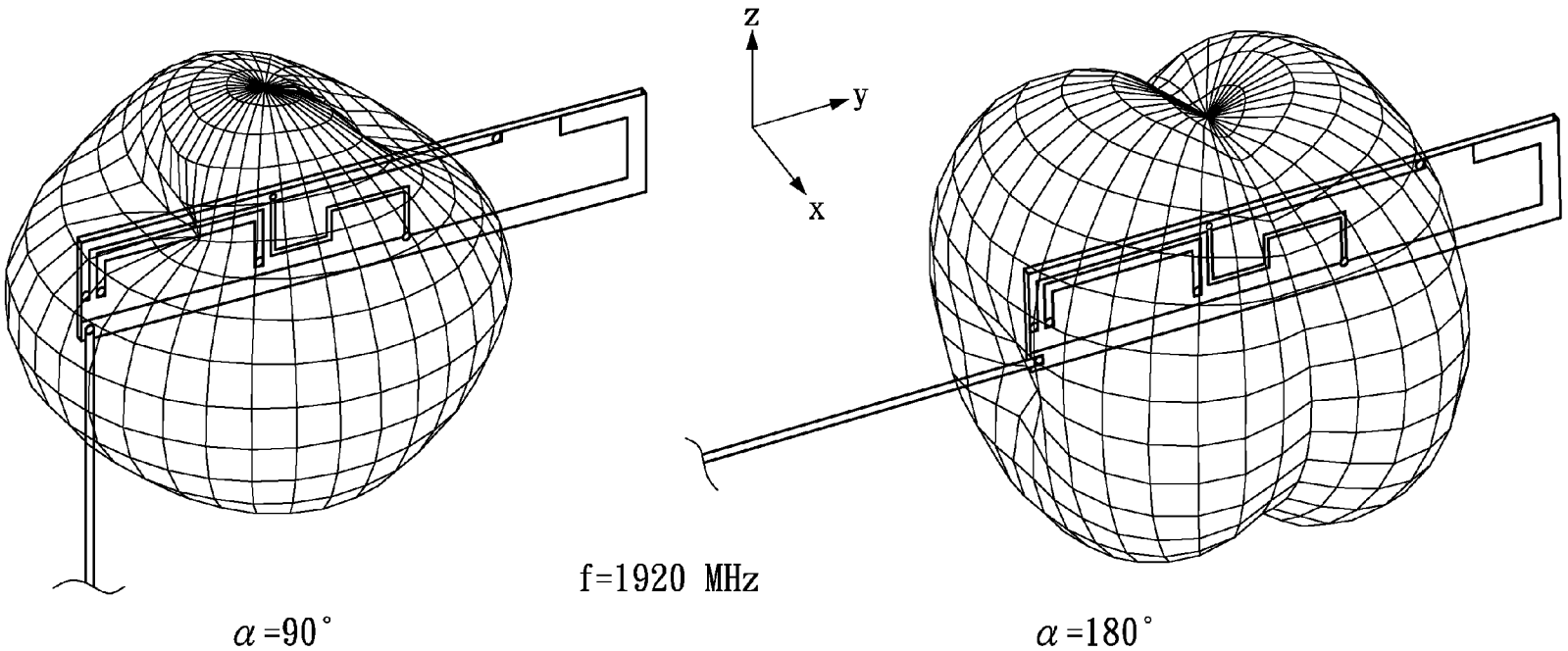
FIG. 3 shows a radiation pattern diagram of a multi-band antenna operated at the band of 1920 megahertz according to an exemplary embodiment from the present disclosure.

Next, please refer to FIG. 2 in conjunction with FIG. 3, FIG. 2 is a radiation pattern diagram of a multi-band antenna operated at the band of 925 megahertz according to an exemplary embodiment from the present disclosure, and FIG. 3 is a radiation pattern diagram of a multi-band antenna operated at the band of 1920 megahertz according to an exemplary embodiment from the present disclosure. The left side of the FIG. 2 shows a radiation pattern of the multi-band antenna 10 corresponding to the angle α of 90 degrees, and the right side of the FIG. 2 shows a radiation pattern of the multi-band antenna 10 corresponding to the angle α of 180 degrees. The left side of the FIG. 3 shows a radiation pattern of the multi-band antenna 10 corresponding to the angle α of 90 degrees, and the right side of the FIG. 3 shows a radiation pattern of the multi-band antenna 10 corresponding to the angle α of 180 degrees. According to FIG. 2 and FIG. 3, the radiation pattern of the multi-band 10 relates to the angle α between the matching conductor 106 and the antenna ground 102.

Figure 4:
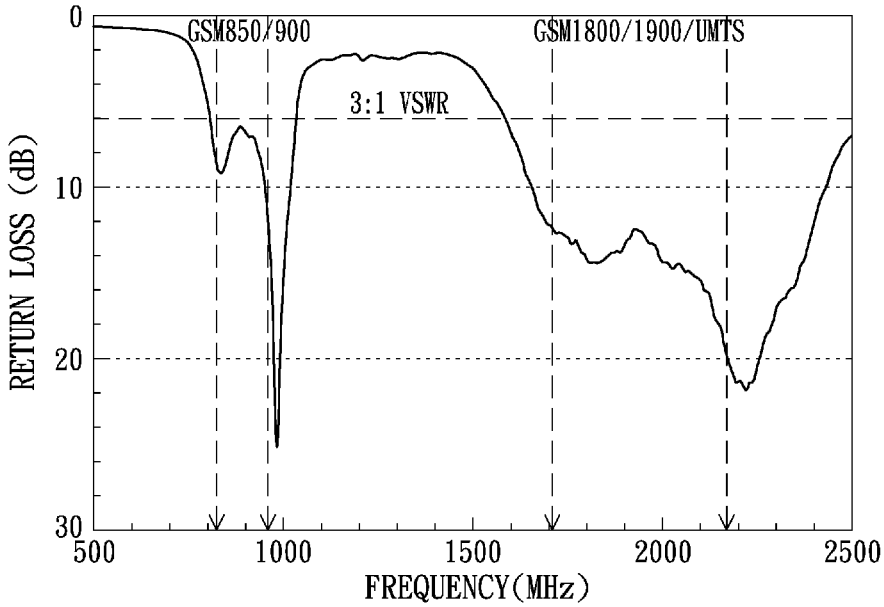
FIG. 4 shows a return loss curve diagram of a multi-band antenna according to an exemplary embodiment from the present disclosure.

Next, please refer to FIG. 4 which is a return loss curve diagram of a multi-band antenna according to an exemplary embodiment from the present disclosure. In the curve diagram of the FIG. 4, the Voltage Standing Wave Ratio (VSWR) of the multi-band antenna 10 is 3:1. When the multi-band antenna 10 operates at GSM 850/900 band and GSM 1800/1900 band (or UMTS band), the impedance-bandwidth can meet requirement of the 6 dB return loss. Therefore, the multi-band antenna 10 may have great radiation efficiency, and operate at the bands specified by the communication standards of the general phone products.

Figure 5:
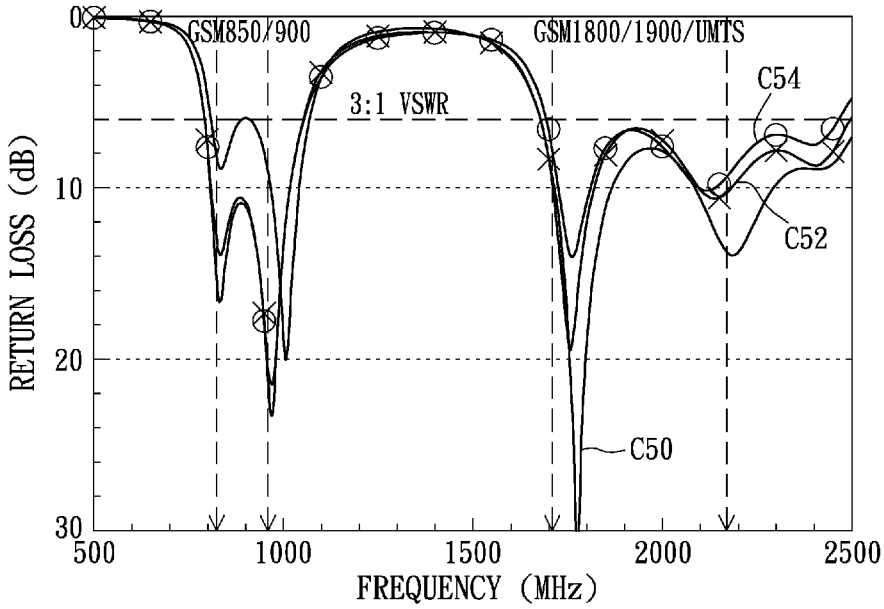
FIG. 5 shows a return loss curve diagram of different frequencies and angles between an antenna ground and a matching conductor of a multi-band antenna according to an exemplary embodiment from the present disclosure.

Please refer to FIG. 5 which is a return loss curve diagram of different frequencies and angles between an antenna ground and a matching conductor of a multi-band antenna according to an exemplary embodiment from the present disclosure. Curve C50, C52, and C54 show the return loss curves of the angle α of 90, 135, and 180 degrees respectively. According to the FIG. 5, even though the multi-band antenna 10 changes the angle α for adjusting radiation pattern, the impedance-bandwidth of the multi-band antenna 10 can still meet the requirement of 6 dB return loss when the multi-band antenna 10 provided from the exemplary embodiment of the present disclosure operates at GSM 850/900 band, GSM 1800/1900 band, and UMTS band.

[Another Exemplary Embodiment of the Multi-Band Antenna]

Figure 6:
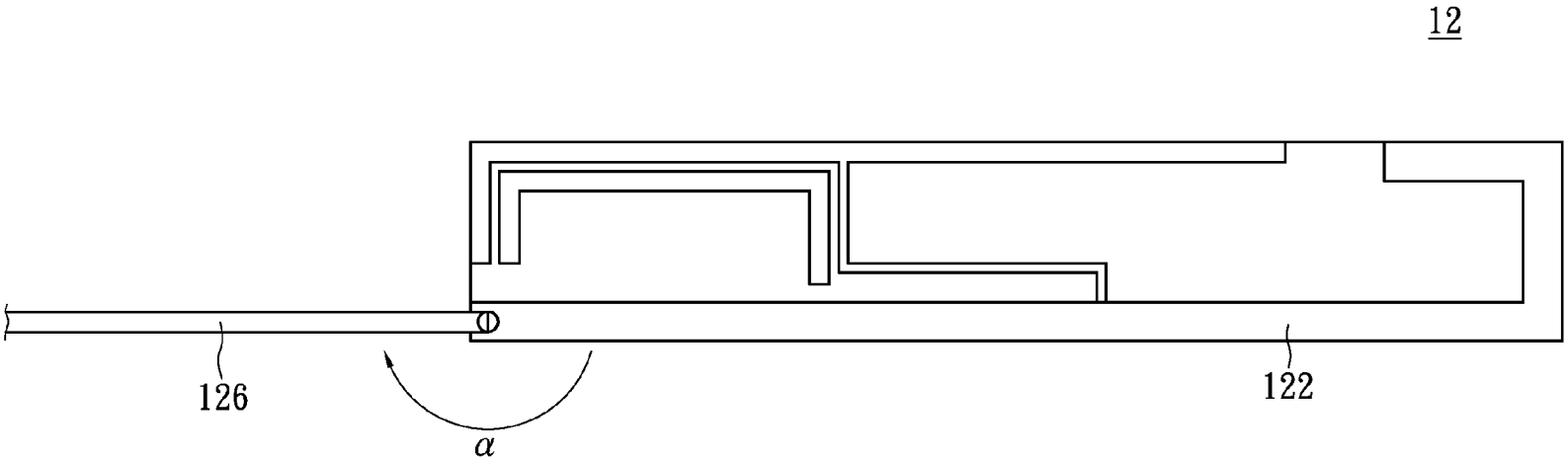
FIG. 6 shows a plan view of a multi-band antenna according to another exemplary embodiment from the present disclosure.

Please refer to FIG. 6 which is a plan view of a multi-band antenna according to another exemplary embodiment from the present disclosure. The difference between the multi-band antenna 12 of the FIG. 6 and the multi-band antenna 10 of the FIG. 2 is described as follows. The angle α between the antenna ground 102 and the matching conductor 106 is 90 degrees in the multi-band antenna 20 of the FIG. 1, but the angle α between the antenna ground 122 and matching conductor 126 is 180 degrees in the multi-band antenna 12 of the FIG. 6. As mentioned earlier, the angle α between the antenna ground and the matching conductor may be from 0 to 180 degrees, and the radiation pattern of the multi-band antenna 10 may be controlled by adjusting the angle α.

[Another Exemplary Embodiment of the Multi-Band Antenna]

Figure 7:
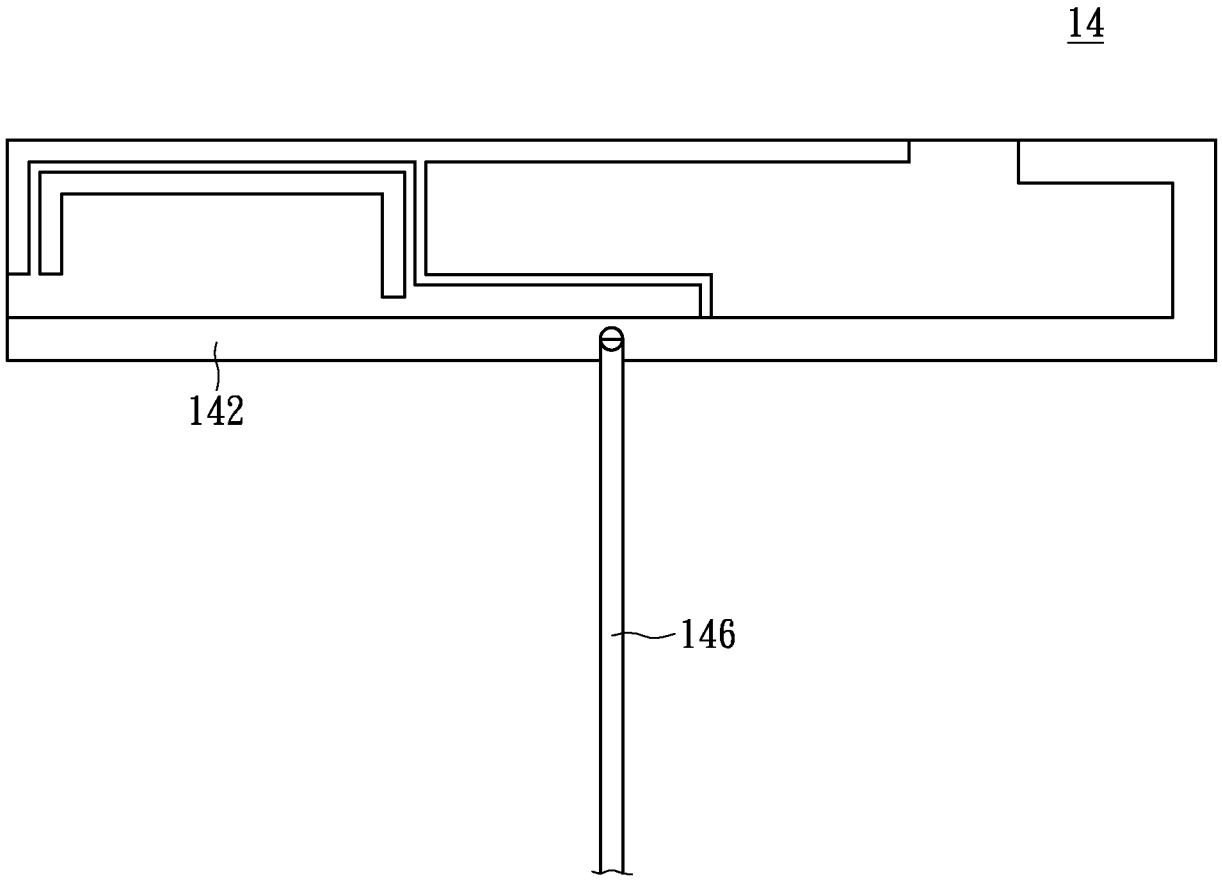
FIG. 7 shows a plan view of a multi-band antenna according to another exemplary embodiment from the present disclosure.

Please refer to FIG. 7 which is a plan view of a multi-band antenna according to another exemplary embodiment from the present disclosure. The difference between the multi-band antenna 14 of the FIG. 7 and the multi-band antenna 10 of the FIG. 1 is described as follows. One end of the matching conductor 106 of the multi-band antenna 10 is electrically coupled to the left of the antenna ground 102 in the FIG. 1, but one end of the matching conductor 146 of the multi-band antenna 14 is electrically coupled to the middle of the antenna ground 142. As mentioned earlier, the coupled location between the matching conductor and the antenna ground is not used for limiting the present disclosure.

[Another Exemplary Embodiment of the Multi-Band Antenna]

Figure 8:
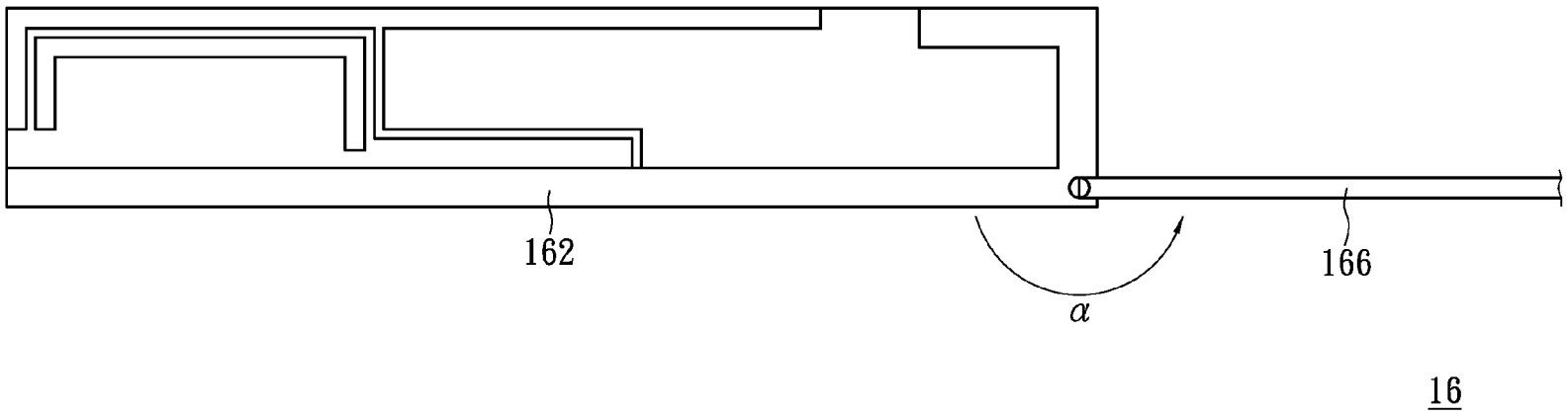
FIG. 8 shows a plan view of a multi-band antenna according to another exemplary embodiment from the present disclosure.

Please refer to FIG. 8 which is a plan view of a multi-band antenna according to another exemplary embodiment from the present disclosure. The difference between the multi-band antenna 16 of the FIG. 8 and the multi-band antenna 10 of the FIG. 1 is described as follows. The matching conductor 106 of the multi-band antenna 10 is located in left of the antenna ground 102 in the FIG. 1, but the matching conductor 166 of the multi-band conductor 16 is located in right of the antenna ground 162 and the angle α between the matching conductor 166 and the antenna ground 162 is 180 degrees in the FIG. 8. As mentioned earlier, the coupled location between the matching conductor and the antenna ground, and the angle α are not utilized for limiting the present disclosure.

[Another Exemplary Embodiment of the Multi-Band Antenna]

Figure 9:
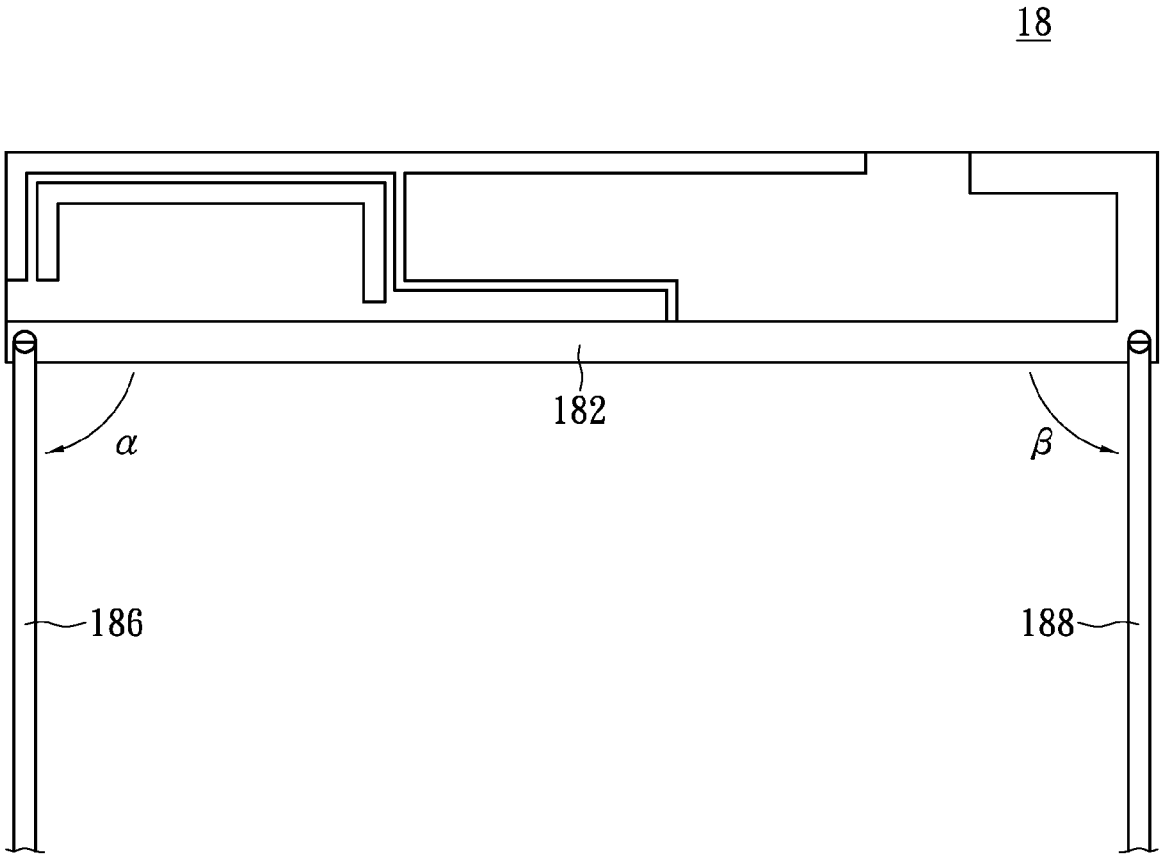
FIG. 9 shows a plan view of a multi-band antenna according to another exemplary embodiment from the present disclosure.

Please refer to FIG. 9 which is a plan view of a multi-band antenna according to another exemplary embodiment from the present disclosure. The difference between the multi-band antenna 18 of the FIG. 9 and the multi-band antenna 10 of the FIG. 1 is described as follows. The multi-band antenna 10 only has one matching conductor 106 located in left of the antenna ground 102 in the FIG. 1, but the multi-band antenna 18 has two matching conductors 186 and 188 respectively located in two sides (the left and right) of the antenna ground 182, wherein there is an angle β between the matching conductor 188 and the antenna ground 182. According to the exemplary embodiment of the present disclosure, the angle α and the angle β are both 90 degrees, and a length of the matching conductor 188 is about a quarter of the wavelength corresponding to any frequency (such as center frequency) of the second operating band. As mentioned earlier, the amount of the matching conductors of the multi-band is not used for limiting the present disclosure.

[Exemplary Embodiment of the Electronic Apparatus Having the Multi-Band Antenna]

Figure 10:
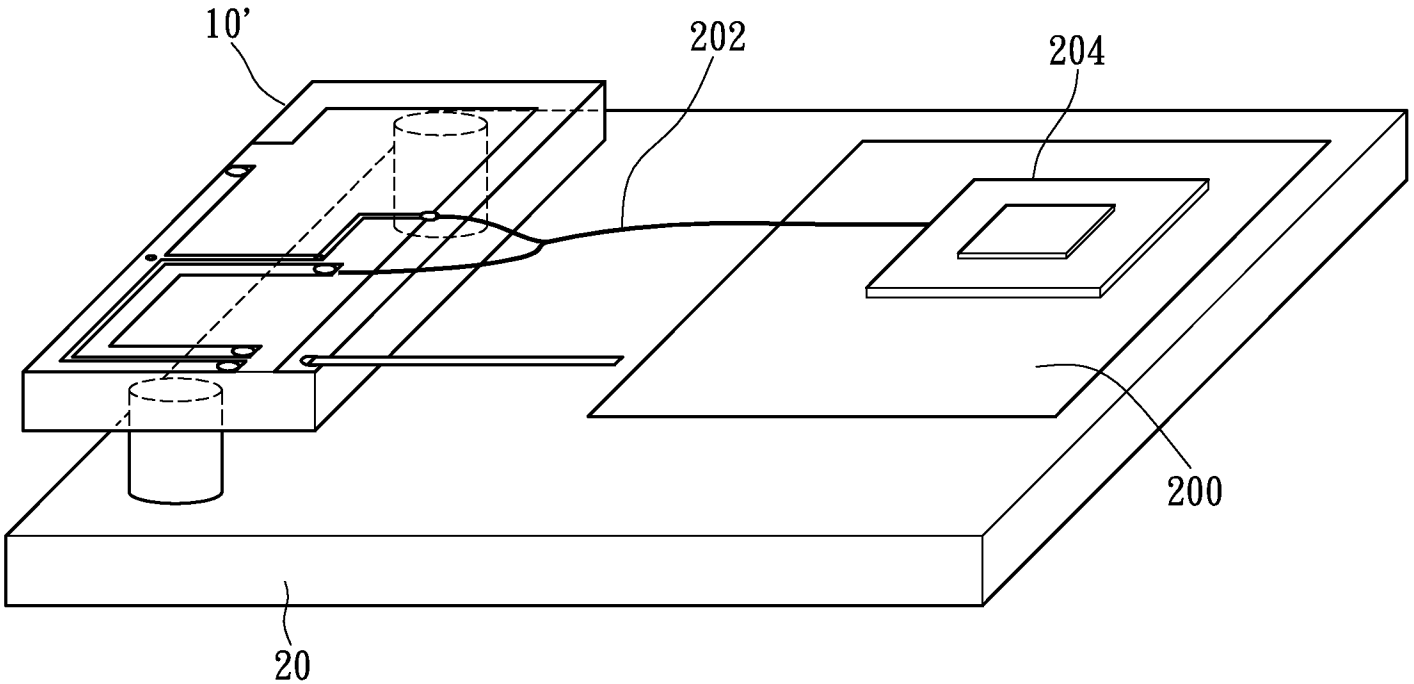
FIG. 10 shows a three-dimensional drawing of an electronic apparatus had the multi-band antenna according to an exemplary embodiment from the present disclosure.

Please refer to FIG. 10 which is a three-dimensional drawing of an electronic apparatus had the multi-band antenna according to an exemplary embodiment from the present disclosure. The electronic apparatus includes a multi-band antenna 10' and an electronic apparatus body, wherein the multi-band antenna 10' in the FIG. 10 may be the multi-band antenna of any above-mentioned exemplary embodiment. According to the exemplary embodiment, the multi-band antenna 10' is located in the electronic apparatus, and the multi-band band antenna 10' is located on the electronic apparatus body 20 by utilizing the fixing means, wherein the fixing means, such as utilizes the copper vias, sponges or connectors for fixing, may make the multi-band antenna 10' be located on the electronic apparatus body 20. It is noteworthy that the above-mentioned fixing means is not used for limiting the present disclosure.

The electronic apparatus body 20 includes a system ground 200, a cable 202, and at least one electronic chip 204, wherein the electronic chip 204 located on the system ground 200 is for transmitting Radio-Frequency (RF) signals to the multi-band antenna 10' or receiving the RF signals from the multi-band antenna 10'. The electronic apparatus body 20 may be a circuit board, a mobile phone apparatus, a computer apparatus, and so on. In the multi-band antenna 10', the signal feeding terminal and the signal ground terminal are respectively electrically coupled to the signal wire and the ground wire of the cable 202. In other words, the cable 202 is utilized for electrically coupling the multi-band antenna 10' and the electronic chip 204 of the electronic apparatus body 20. The antenna ground of the electronic apparatus may be not integrated with the system ground, thus reducing the cost of the antenna design.

To sum up, the exemplary embodiment of the present disclosure provides a multi-band antenna and electronic apparatus having the same. The multi-band antenna has the great radiation efficiency and multi-band operation. In other words, the multi-band is an independent antenna, and manufacturers don't have to redesign antenna for different types of electronic products. Consequently, the manufacturing cost is reduced. Furthermore, the radiation pattern of the multi-band antenna may be changed by adjusting the angle between the matching conductor and antenna ground. In addition, the multi-band antenna may also be adapted to Multiple Input Multiple Output (MIMO) system.

In order to further understand the techniques, means and effects the present disclosure, the following detailed descriptions and appended drawings are hereby referred, such that, through which, the purposes, features and aspects of the present disclosure can be thoroughly and concretely appreciated; however, the appended drawings are merely provided for reference and illustration, without any intention to be used for limiting the present disclosure.

What is claimed is:

1. A multi-band antenna, comprising:

an antenna substrate;

an antenna ground, located on the antenna substrate, having a signal ground terminal and at least one bend;

an antenna unit, located on the antenna substrate, being adjacent to the antenna ground, and providing a first and second operating bands, wherein the antenna unit comprises:

a coupling conductor;

a feeding conductor, located between the antenna ground and the coupling conductor, extending along the coupling conductor, and having a signal feeding terminal corresponding to the signal ground terminal, wherein there is a first distance between the feeding conductor and the coupling conductor;

a radiating conductor, one end thereof being electrically coupled to the coupling conductor, and the other end thereof facing to the antenna ground, wherein there is a second distance between the radiating conductor and the antenna ground; and a shorting conductor, two ends thereof being respectively electrically coupled to the coupling conductor and the antenna ground; and a first matching conductor, one end thereof being electrically coupled to the antenna ground, and the length thereof being about a quarter of the wavelength corresponding to a frequency of the first operating band, wherein there is a first angle between the first matching conductor and the antenna ground.

2. The multi-band antenna according to claim 1, wherein the width of the antenna ground is less than or equal to one-tenth of the length of the antenna ground.

3. The multi-band antenna according to claim 1, wherein the frequency of the first operating band is the center frequency of the first operating band.

4. The multi-band antenna according to claim 1, wherein the range of the first angle is from 0 to 180 degrees.

5. The multi-band antenna according to claim 1, further comprising:

a second matching conductor, one end thereof being electrically coupled to the antenna ground, and the length thereof being about a quarter of the wavelength corresponding to a frequency of the second operating band, wherein there is a second angle between the second matching conductor and the antenna ground.

6. The multi-band antenna according to claim 5, wherein the frequency of the first operating band is the center frequency of the first operating band, and the frequency of the second operating band is the center frequency of the second operating band.

7. The multi-band antenna according to claim 5, wherein the range of the first and second angles are both from 0 to 180 degrees.

8. The multi-band antenna according to claim 1, wherein at least one of the matching conductor, the coupling conductor, the feeding conductor, the radiating conductor and the shorting conductor is a wire.

9. The multi-band antenna according to claim 1, wherein the shape of the antenna substrate is an elongated rectangle.

10. The multi-band antenna according to claim 1, wherein the antenna ground is an elongated wire.

11. The multi-band antenna according to claim 1, wherein the first operating band comprises GSM850/900 band, and the second operating band comprises GSM1800/1900/UMTS band.

12. The multi-band antenna according to claim 1, wherein the first distance is 0.5 millimeter.

13. An electronic apparatus, comprising:

an electronic apparatus body, having a system ground, a cable including a ground wire and a signal wire, and at least one electronic chip, wherein the electronic chip is located on the system ground; and a multi-band antenna, electrically coupled to the electronic chip of the electronic apparatus body via the cable, comprising:

an antenna substrate;

an antenna ground, located on the antenna substrate, having a signal ground terminal and at least one bend, wherein the signal ground terminal is electrically coupled to the ground wire of the cable;

an antenna unit, located on an antenna substrate, being adjacent to the antenna ground, and providing a first and second operating bands, wherein the antenna unit comprises:

a coupling conductor;

a feeding conductor, located between the antenna ground and the coupling conductor, extending along the coupling conductor, and having a signal feeding terminal corresponding to the signal ground terminal, wherein there is a first distance between the feeding conductor and the coupling conductor, and the signal feeding terminal is electrically coupled to the signal wire of the cable;

a radiating conductor, one end thereof being electrically coupled to the coupling conductor, and the other end thereof facing to the antenna ground, wherein there is a second distance between the radiating conductor and the antenna ground; and a shorting conductor, two ends thereof being respectively electrically coupled to the coupling conductor and the antenna ground; and a first matching conductor, one end thereof being electrically coupled to the antenna ground, and the length thereof being about a quarter of the wavelength corresponding to a frequency of the first operating band, wherein there is a first angle between the first matching conductor and the antenna ground.

14. The electronic apparatus according to claim 13, wherein the width of the antenna ground is less than or equal to one-tenth of the length of the antenna ground.

15. The electronic apparatus according to claim 13, wherein the range of the first angle is from 0 to 180 degrees.

16. The electronic apparatus according to claim 13, wherein the multi-band antenna further comprises:

a second matching conductor, one thereof being electrically coupled to the antenna ground, and the length thereof being about a quarter of the wavelength corresponding to a frequency of the second operating band, wherein there is a second angle between the second matching conductor and the antenna ground.

17. The electronic apparatus according to claim 16, wherein the frequency of the first operating band is the center frequency of the first operating band, and the frequency of the second operating band is the center frequency of the second operating band.

18. The electronic apparatus according to claim 16, wherein the range of the first and second angles are both from 0 to 180 degrees.

19. The electronic apparatus according to claim 13, wherein at least one of the matching conductor, the coupling conductor, the feeding conductor, the radiating conductor and the shorting conductor is a wire.

20. The electronic apparatus according to claim 13, wherein the first operating band comprises GSM850/900 band and the second operating band comprises GSM1800/1900/UMTS band.

* * * * *